US008420584B2

(12) United States Patent
Thoele et al.

(10) Patent No.: US 8,420,584 B2
(45) Date of Patent: Apr. 16, 2013

(54) ENZYMATIC DETERGENT

(76) Inventors: Melton Sherwood Thoele, Fincastle, VA (US); Alex Ladato, Bronx, NY (US)

( * ) Notice: Subject to any disclaimer, the term of this patent is extended or adjusted under 35 U.S.C. 154(b) by 46 days.

(21) Appl. No.: 12/802,365

(22) Filed: Jun. 4, 2010

(65) Prior Publication Data

US 2010/0249005 A1 Sep. 30, 2010

Related U.S. Application Data

(63) Continuation-in-part of application No. 11/731,403, filed on Mar. 30, 2007, now abandoned.

(51) Int. Cl.

| | |
|---|---|
| ***C11D 3/02*** | (2006.01) |
| ***C11D 3/16*** | (2006.01) |
| ***C11D 3/50*** | (2006.01) |
| ***C11D 3/60*** | (2006.01) |

(52) U.S. Cl.
USPC ..... 510/161; 510/108; 510/179; 510/392; 510/393; 510/405; 510/530

(58) Field of Classification Search ..... 510/108, 510/161, 179, 392, 393, 405, 530
See application file for complete search history.

(56) References Cited

U.S. PATENT DOCUMENTS

| | | | | |
|---|---|---|---|---|
| 4,456,544 | A | 6/1984 | Lupova et al. | |
| 5,073,292 | A | 12/1991 | Hessel et al. | |
| 5,124,066 | A | 6/1992 | Russell | |
| H1467 | H | 8/1995 | Prieto et al. | |
| H1513 | H | 1/1996 | Murch et al. | |
| 5,510,052 | A | 4/1996 | McCandlish | |
| 5,529,788 | A | 6/1996 | DeSenna | |
| 5,567,385 | A | 10/1996 | Miller et al. | |
| 5,589,507 | A | 12/1996 | Hall | |
| 5,810,944 | A | 9/1998 | Smithkowski | |
| H1776 | H | 1/1999 | Linard | |
| 6,235,692 | B1 | 5/2001 | Scoville | |
| 6,387,858 | B1 | 5/2002 | Shah et al. | |
| 6,420,332 | B1 | 7/2002 | Simpson | |
| 7,012,053 | B1 * | 3/2006 | Barnabas et al. | 510/287 |
| 7,211,552 | B1 * | 5/2007 | Thoele | 510/161 |
| 2002/0103096 | A1 | 8/2002 | Kott et al. | |
| 2007/0241306 | A1 * | 10/2007 | Wehner et al. | 252/67 |

OTHER PUBLICATIONS

Stepan Specialty alkoxylates, Feb. 2012.*

* cited by examiner

*Primary Examiner* — Lorna M Douyon
*Assistant Examiner* — Amina Khan
(74) *Attorney, Agent, or Firm* — James W. Hiney

(57) ABSTRACT

A non-toxic enzymatic detergent for use in cleaning surgical instruments and the like which have a large build-up of bio-residue thereon and which need specialty cleaning in order to avoid both hardened bio-residue and certain fluid traces from the instruments for both operating accuracy as well as sterilization requirements.

29 Claims, No Drawings

ENZYMATIC DETERGENT

This application is a Continuation-In-Part of U.S. application Ser. No. 11/731,403 filed on Mar. 30, 2007 now abandoned, in the United States Patent & Trademark Office. The new sections of this application are underlined for clarity's sake and to afford the Examiner an efficient method in reviewing the new material. A copy of this specification without the underlining is provided as well for PTO compliance purposes.

This invention relates to a new and improved enzymatic detergent which is designed for cleaning surgical instruments and the like. The detergent contains elements specifically designed to remove certain fluid traces from surgical instruments such as blood, lipids, etc. The invention is for use on Orthopaedic, Laparoscopic, Neurological and Microsurgical instrumentation as well as for rigid and flexible scopes and other instruments.

BACKGROUND

Surgical instruments and equipment, when used, inevitably pick up amounts of bio-burden on them after being employed in operations on humans or animals. The definition of instruments includes ridged and flexible scopes, laparoscopic instruments, trays and anything that gets soiled with body fluids which result in them having varying amounts of bio-burden on them after being so used. The body fluids, such as blood, lipids and synovial fluids from joints, form an adhesive like bond to the items used during surgeries and animal processing or operations. As these fluids dry, the adhesive like bonds get stronger and the fluids get harder to dissolve using ordinary cleaning methods. The adhesive like bond becomes too strong to break for normal detergents which contain only surfactants and inorganic reagents because routine detergents are chemically and physically unable to dissolve or react with many body fluids. The chemical structures of these detergents do not allow them to react with body fluids without the body fluids first being changed by other chemicals like enzymes. Enzymes like protease and amylase break these body fluids down by the chemical reaction called hydrolysis which also breaks down their adhesive bond to the items the fluids are adhered to. When broken down in this manner, body fluids become more soluble in surfactants and can then be washed away.

EXISTING CLEANSERS

All of the currently used cleansers or detergents employed to clean body fluids and soil off surgical, medical and animal processing or operative items react very slowly and require multiple steps and processes. It is not unusual for these cleansers to take up to 10 or 20 minutes to clean. Such multiple steps and processes include:

1. Pretreatment immediately after use, as in the operating room, with gels to keep the items moist.
2. Sonicating the items with high frequency sound waves in an enzymatic solution to help dissolve and speed up the cleaning process.
3. Soaking in an enzymatic solution 10 to 20 minutes to help remove the body fluids and soil, and
4. Scrubbing with a metal brush to remove the body fluids still left on the items even after completing steps 1 through 3.

Current enzymatic cleansers require these steps and processes as they do not have appropriate builders to increase surfactant and enzyme cleaning ability. In addition, they don't have correct buffers for stabilizing the pH at the high level, approximately 9 to 11, required for optimum enzyme activity, other enzyme enhancers and metal cleaning compounds in a single cleanser. All of the current enzymatic cleansers used to clean these items can only remove body fluids and soil and only after going through some or all of the steps and processes outlined above as they do not contain the compounds to remove bonded inorganic material from metals. None of them remove the metallic oxides, carbonates and sulfides that get bonded to these items, especially metals, from exposure to elements in body fluids, soil and air that leaves these compounds on them as white and gray film or spots. The current enzymatic cleansers cannot remove this film and/or spots as they do not contain the chemicals that bond to and solubilize these ions, like sequestering agents.

Many of the enzymatic cleansers currently available on the market can only be used on certain types of materials as they contain corrosives like hydroxides and strong organic solvents like alcohol, that corrode aluminum, steel and plastics. None of the currently available cleansers will clean the inside of a laparoscopic instrument tube without putting a tube brush through them initially to unblock the residue in them because these cleaners do not contain enhancers that increase the enzymatic activity and surfactant strength. Since they do not contain these enhancers, the cleaners require a usage rate of a minimum of one ounce per gallon of water to accomplish what little they do. Some of these current enzymatic cleansers also contain toxic chemicals like ethylene glycol which is an auto antifreeze and flammable solvents such as ethyl and/or isopropyl alcohol.

Prior Patents and Publications

The prior art patents do not disclose the current invention. U.S. Pat. No. 4,456,544, to Lupova et al, discusses a detergent composition for treating surgical instruments and equipment which contains seven proteolytic enzymes (proteases) to ensure hydrolysis of various protein contaminations. The Lupova preparation is used in a presterilization treatment of medical instruments. It does not have all the compounds of the instant invention.

U.S. Pat. No. 5,124,066, to Russel (assigned to Lever Brothers Co.) shows a liquid detergent which includes a glycerol ether, an enzyme and boric acid but is not designed for cleaning medical instruments.

The patent to Hessel, et al, U.S. Pat. No. 5,073,292, discloses a cleaning composition having from 5 to 85% by weight of a surfactant, an enzyme and protein to stabilize the enzyme. Again, the patent fails to disclose the unique combination of compounds of the instant invention.

DeSenna, U.S. Pat. No. 5,529,788, discloses a tablet containing an enzyme for use in ultrasonic cleaning equipment. It fails to show the compounds of the instant invention. U.S. Pat. No. 5,510,052, to McCandlish, discloses a pretreatment sterilant for dishware which removes baked-on, dried-on and cooked on food wastes. There is no discussion of the problem that the instant invention solves.

Miller et al, U.S. Pat. No. 5,567,385, discloses an sterilant for use in alkaline oxidation of medical waste during shredding of the product. Again, there is no disclosure of the unique compounds of applicant nor discussion of the problems confronted by him.

U.S. Pat. No. 5,589,507, to Hall, discusses a composition for sterilizing medical devices using formic acid, an oxidizer, performic acid and water but which works totally differently from that shown by applicant.

Smithowski et al, U.S. Pat. No. 5,810,944, shows a cleansing concentrate for cleaning surgical instruments which incorporates sulphate salt together with other aids. However, this cleanser requires many steps as discussed above and does not contain the unique combination of compounds shown by applicant.

The U.S. patent to Scoville, U.S. Pat. No. 6,235,692, discusses a foaming enzyme composition for cleaning instruments which contains antimicrobial agents and a corrosion inhibitor. It works differently than the instant invention.

U.S. Pat. No. 6,387,858, to Shah et al, discusses the same problem that applicant is solving but, as stated above, treats the instruments with a gel to prevent the residue from hardening.

Simpson, U.S. Pat. No. 6,420,332, shows a blood and stain remover, which includes a protease, an amylase, an enzyme having calcium, alcohol and an alkanolamine, a non-ionic detergent and water. While this solution may include some of the compounds disclosed by applicant, it is very different In addition, there are the references cited in the co-pending application of the same inventor, Ser. No. 10/813,966 which are discussed and argued therein and are listed as follows:

| | |
|---|---|
| U.S. Pat. No. 6-239,089 | Cala et al |
| U.S. Pat. No. 5,451,342 | Desai, S. G. |
| U.S. Pat. No. 3,829,563 | Barry et al |
| US H0,001,818 | Potgeister et al |

Patent Application Publications

The application by Kott et al, No 2002,0103096, discloses a cleaning surfactant composition comprising an alkylarylsulfonate surfactant system having two isomers, different from that disclosed by applicant.

Statutory Invention Registrations

Registration No. H1467, to Prieto et al, relates to a detergent containing an active surface composition with nonionic surfactant components and an alkyl sulfate anionic surfactant component. This is used as a general cleaning detergent for heavy duty use and does not address the problem addressed by applicant.

Registration H1513, to Murch et al, discloses a detergent composition having olecoyl sarcosinate and polyhydroxy fatty acid amide surfactants for improved cleaning function for general laundry cleaning.

Registration H1776, to Linard, shows an enzyme containing detergent having a pH of 9.5 or greater.

Thus it is shown that none of the prior art patents, publications or Registrations disclose treating the problem of body fluid waste and metallic ion residue adhering to medical instruments and items with the same unique detergent composition.

GENERAL DESCRIPTION

The new instant enzymatic cleanser is formulated to remove all types of bio-burden, soil, body fluids and the metallic oxidescarbonates, and sulfides previously mentioned. Tests have shown that all of these specific unwanted adherents are removed by the cleanser.

The new enzymatic cleansers are formulated to remove all types of bio-burden, soil, body fluids and the metallic oxides (except aluminum oxide) carbonates and sulfides previously mentioned.

Aluminum oxide is the dull protective coating on aluminum and anodized oxide coating. The instant composition will not hurt the protective aluminum oxide coating on aluminum items as it does not contain the hydroxides or any other chemical that will react with aluminum oxide. It can remove all the residues mentioned previously as it contains enzymes for the body fluids not soluble in surfactants, such as soaps, and surfactants for oils and soil. It has inorganic and organic metallic ion binders, sequestering agents, for removing the metallic oxides, carbonates and sulfides, and it has enzyme activity enhancers and surfactant builders. These ingredients also make all of the items soaked in this cleanser residue free and the metals shiny with no white or gray film or spots. This is so due to the fact that the metallic ions are kept bonded to the sequestering agents that are soluble in water and the surfactants hold these and all of the other residue in suspension until the residue can be washed away with a simple water rinse, unlike all the existing cleansers and the ones discussed in the prior patents, publications and Registrations.

Since this new formula cleans so thoroughly by stripping away all residue, including metallic ion film, and since it has a pH between 8 and 9 or 7 and 8.5 when diluted as directed (This depends on the hardness of the water it is diluted in) all the items are free of microbial contamination when cleaned in this new enzymatic cleanser. Independent testing has shown that all items washed in these cleansers are microscopically clean after rinsing. The formula can produce a clear cleaning liquid. This formula is safe to use on all types of materials these items are typically constructed of, including plastic, glass and all metals, including aluminum. It works in this safe manner as it has no hydroxides, acids or corrosives and it has no strong, toxic or corrosive organic solvents. However, this cleanser is strong enough to even clean the inside of laparoscopes without using a tube scrubber either before or after soaking in an aqueous dilution of this formula for only a few minutes (2 to 5). The reason for this is that the activity of the enzymes and surfactants are greatly increased by the surfactant builders and enzyme enhancers in this formula.

With this new cleanser all items can be cleaned with no pretreatment to keep them moist, no sonicating and no scrubbing either before or after soaking. It cleans all items from 2 to 5 minutes using a dilution rate of one half of the rate of all other similar cleansers. The dilution rate is one half ounce per gallon of water for all but extreme cases like synovial fluid from joint surgeries and body fluid clogged laparoscopes, where one ounce per gallon of water is recommended. This new cleanser works faster, cleans better, with less product and with only soaking because of its surfactant builders and enzyme enhancers. It is low-foaming as none of the ingredients will support sustained foaming in water when used as directed. All ingredients are biodegradable according to the manufacturers product specification and chemical reference books like the Merck Index. This cleanser/detergent is nontoxic and environmentally safe when used as directed (one ounce per gallon of water maximum) and all individual ingredient concentrations are below city water out-flow limits in most instances. This is based on the typical amount of hospital out-flow (over 1000 gallons) and typical city out-flow concentration limits (112.5 parts per million maximum per the city of Roanoke, Va., water treatment facility, for instance) of the regulated ingredients (sodium Tripolyphosphate). It is nontoxic, when used as directed, based on each ingredients material safety sheet.

With the improved cleaning product the technique of cleaning involves the soiled instruments (usually stained with body fluids) are either sprayed with an enzymatic detergent to keep the soil from drying out and the cleaning process is started or the instruments are put into a tray.

The technicians handling the cleaning process will fill a deep sink or sonicator with fairly warm tap water (100 to 110° F.) and then add the improved detergent at a ratio of from ¼ to 1 oz. detergent per gallon of water in the sink or sonicator, depending on the particular hospitals cleaning procedure, which concentration is used and how soiled the instruments are. It is recommended to add the detergent after the water is put into the sink or sonicator and then stirring the mix to obtain a uniform consistency. Some prefer to add the detergent first which produces more sudsing action. Either way is acceptable because of this improved formulation.

The tray of instruments is then added to the water/detergent mix and let soak for some 2 to 5 minutes depending on the amount of body fluids that are on the instruments and how long they have been sitting after being soiled. If the soil is allowed to dry on the instruments it may take more than 2 minutes soaking time.

The instruments are then rinsed with tap or deionized water and if clean enough they will be prepared for sterilization. Using the instant detergent they are ready to be sterilized but most hospitals still perform a further washing. The instruments are then put into an automatic washer, which is specially designed for washing instruments. The automatic washers are usually set up to do a soaking cycle, a washing cycle and a rinsing, cycle. The soaking cycle will have an enzymatic detergent added as the water is being added. With the new improved detergent usually one-eighth to one oz. per gallon of water is added. The washing cycle will have an enzymatic detergent or non-enzymatic detergent added, at the same ratio of one eighth to one oz., and the rinsing cycle is usually de-ionized water. Then the instruments are prepared for sterilizing.

The instant detergent without enzymes is used for the automatic washers. The normal concentrated version (with enzymes) is used for the spray, in the soaking process, sonic baths and, on occasion, in the automatic washers. There is one enzymatic detergent and one non-enzymatic detergent used and the latter one is only used in the automatic washer.

OBJECTS OF THE INVENTION

Accordingly, it is an object of this invention to provide a new improved cleansing composition for medical instruments and items, and It is another object of this invention to provide a medical instrument cleanser that requires no pretreatment to keep them moist, nor any pretreatment with gels, and It is still another object of this invention to provide an improved medical instrument cleanser that does not require any sonicating, and It is a further object of this invention to provide a medical instrument cleanser which does not require any scrubbing of the instruments before or after cleaning, and A still further object of the invention is to provide a cleanser for medical and animal operative instruments and items that will remove all body-fluid residue and metallic oxides, carbonates and sulfides therefrom in an efficient manner, and Another object of this invention is to provide a biodegradable, low-foaming non-toxic, cleansing agent for medical instruments and items, and A further object of this invention is to provide a superior low-foaming cleansing agent for medical instruments with a balanced ratio of ingredients to produce superior cleansing, and A yet further object of this invention is to provide an improved medical instrument and item cleanser having calcium chloride, sodium formate, sodium tripolyphosphate, sodium xylene sulfonate, anionic and nonionic surfactants, a protease enzyme and a amylase enzyme.

These and other objects will become clear when reference is had to the accompanying specific description and examples.

SPECIFIC CHEMICALS USED IN THE INVENTION

The ingredients used in the invention can be identified by their CAS number and they are as follows and, in this amendment, the corresponding Exhibit number is given herewith.

LS 54 is a blend of low foaming fatty alcohols EO/PO derived carbon chain lengths C12-C14 which is a nonionic surfactant. CAS number is 68439-51-0. See Exhibit F.

Dehypon E124-90 is a low foaming fatty alcohol polyglycol ether which is a nonionic surfactant. This is a Cognis material and both the carbon chain length blend and the CAS numbers are proprietary per Cognis. Only they make this blend and they will not divulge any other information. See Exhibit A AS 48, also called Simulsol AS 48, has a carbon chain length of C8 and is an alkyl polygucoside which is a low foaming solubilizer for water in oil mixtures. Product code 38322E. (INCI) International cosmetic ingredients name 2-ethylhexyl glucoside, CAS number 108081-06-7, EC number 500-529-1, registered number 3269895. See Exhibit H 31R1, also called Meroxapol, 311, is a difunctional block eo/po copolymer which is a nonionic surfactant with an average molecular weight of 3250 and the CAS number is 9003-11-6. See Exhibit E Makon NF-5 is a non-foaming polyalkoxylated amide product code of 1504. It is a mixture of 3 items: CAS number 64175-92-4 (Oxirane, 2-methyl-polymer with oxirane mono [2-[(1-oxooctyl) amino) methylthyl ether); CAS number 64175-88-8 monoisopropanolamide alkoxylated; CAS number 7732-18-5 water. See Exhibit D HRE 40, also called Eumulgin HRE 40 PH, is PEG (Polyethylene glycol).40 hydrogenated castor oil. A nonionic O/W (oil in water) emulsifier and solubilizer. CAS number is 61788-85-0 See Exhibit G SXS also called Sodium Xylene Sulfonate is a hydrotropic surfactant and solubilizer CAS number 1300-72-7 See Exhibit I Protease L660 also Deterzyme APL-660 is a bacterial alkaline protease which is a non-subtilisin enzyme for hydrolyzing proteins (E.G. 3.4.21) and having CAS number of 9001-92-7 See Exhibit C Amalase 1340 also called Therozyme L340, is a bacterial apha-amyulase for dydrolyzing starch, amylase and amylogpecin. EG number is 3.2.1.1 and CAS number is 900-90-2 Exhibit B

SPECIFIC DESCRIPTION

When used as directed (one ounce per gallon of water maximum) all individual ingredient concentrations are below city water out flow limits. This is based on the usage rate of this cleanser of one half ounce per gallon of water (0.2 grams total phosphate) and the typical city limit of an average of 3.75 pounds total phosphate per day (1701 grams) maximum per the Roanoke, Va. water treatment facility) of the regulated ingredients (sodium Tripolyphosphate). It is nontoxic, when used as directed, based on each ingredient material safety data sheet. It is also odorless and the instruments need no lubricant when used as directed.

The First Preferred Embodiment of the Invention is as Follows

In Phase I the following are mixed together.

The composition of the cleanser includes 64 to 68%, by weight, of water as the main solvent.

One to two percent, by weight, of sodium formate is employed as an enzyme stabilizer, buffering agent and to solubilize trivalent metallic ions which help remove the white and gray film from the instruments and items being cleaned.

From 0.1 to 0.3%, by weight, of calcium chloride. From 0.1 to 0.3%, by weight, of calcium chloride to help activate and stabilize the enzymes, calcium for protease and chlorine for amylase. The chloride is also a source of chloride ion which helps activate amylase enzymes. It is a surfactant builder that greatly increases the cleaning ability of the surfactants.

Sodium tripolyphosphate, 4 to 6% by weight, is used to work as a buffer which greatly increases the cleaning ability of surfactants. It is a sequestering agent for removing metallic ions like calcium and magnesium carbonates, other oxides and sulfides. It also acts as a rust inhibitor and therefore, keeps the instruments from needing a lubricant.

From 9 to 11%, by weight, of sodium xylene sulfonate as a hydrotropic nonionic surfactant to improve the solubility properties of water.

All of the foregoing ingredients are mixed together until all the solids are dissolved.

In Phase 2, the following are mixed with the mixture of Phase I.

Three to Five Percent, by weight, of protease enzyme to remove protein based materials, such a blood, by hydrolysis.

Amylase enzyme, from 1 to 3%, by weight, to remove carbohydrate based materials (sugars, starches, celluloses) by hydrolysis. This also increases the rate of protease enzyme hydrolysis reaction.

These enzymes are then added to the mixture of Phase 1.

In Phase 3, the following are added together and then added to Phase I after the enzymes are added.

Alkoxylated isopropanolamide, from 9 to 11%, by weight, a nonionic surfactant, used as a wetting agent with no foaming and high metallic cleaning capacity. It is also compatable with high pH solutions and enzymes.

From 0.5 to 1.5% of a sodium alkane sulfonate, sodium capryl sulfonate mixture.

This is an anionic surfactant to augment the nonionic surfactants, improving the wetting and cleaning capacities. This is also hydrotropic, low foaming and aids in stability.

Approximately 0.1%, by weight, of a fragrance to give the mixture a pleasant odor.

These ingredients are combined and then added to the combined Phase 1 and Phase 2 mixture.

The Second Preferred Embodiment

1. Initially, 50 to 58% water is used as the main solvent.

2. 0.5 to 2% sodium formate are added as an enzyme stabilizer, buffering agent which solubilizes trivalent metallic ions which helps remove the white and gray film from the items being cleaned.

3. 0.1 to 0.3% calcium chloride is added as a source of calcium to help activate and stabilize the enzymes, calcium for protease and chlorine for amylase. It is also a source of chloride ion which helps activate amylase enzymes.

4. 0.5 to 2.5% sodium tripolyphosphate to work as a buffer to keep the pH near 1 10 which stabilizes the enzymes. It acts as a builder which greatly increases the c cleaning ability of surfactants. It is also a sequestering agent for removing metallic ions like calcium and magnesium carbonates, other oxides and sulfides.

5. 15 to 20% hydrotropic surfactant (Sodium Xylene Sulfonate or Sodium-octy sulfate) to improve the solubility properties of water.

6. 2 to 5% protease enzyme to remove protein based materials (i.e., blood) by hydrolysis.

7. 0.9 to 2.5% amylase enzyme to remove carbohydrate based materials (i.e., sugars, starches and celluloses) by hydrolysis. This action also increases the rate of the protease enzyme hydrolysis reaction.

8. 4 to 5% (Alkoxylated Isopropanolamide or Dehypon LS 54) nonionic surfactant to be used as a cleaning and wetting agent with no foaming and high metallic cleaning action. It is also compatible with high pH solutions and enzymes.

9. 3 to 5% Lauryl Alcohol Alkoxylate to adjust the HLB upward to improve the solubility properties of the lipophilic organics.

10. 0.4 to 0.8% of a sodium alkane sulfonate, mixture as an organic solubilizer It is an anionic surfactant to augment the nonionic surfactants, improving the wetting and cleaning action. It is also hydrotropic, low foaming and aids in stability.

11. 1 to 2% Sodium Borate decahydrate to improve the enzyme long term stability.

12. 3 to 10% Propylene Glycol to improve the enzyme long term stability and lower the freezing point.

13. Approximately 0.1% Propylparaben as a preservative.

14. Approximately 0.1% Methylparaben as a preservative.

15. Approximately 0.1% of a fragrance to give the mixture a pleasant odor.

In preparing the product, Phase I equals half of the water (hot) combined with ingredients 2 and 3.

Phase 2 involves mixing the other half of the water (hot) with ingredients 4 and 5. Ingredients 8, 9, 10, 13, and 20% of ingredient 11 are combined separately and then added to make up the rest of Phase 2.

Phase 3 involves mixing ingredients 6, 7, 12, 13, 14 and the remaining 80% of ingredient 11.

Cool Phase 1 and then add Phase 3 to it.

Cool Phase 2 and slowly add to it the combined Phases 1 and 3.

Improved Embodiment

It has been found that some adjustment in the ratios and proportions lead to improved results.

The alkoxylates and their ratio changes and the addition of a defoamer were needed to reduce the sudsing (foaming) in the sink, sonicator and automatic washers. This allows the user to be able to add the water in the sink during and after the detergent without having too much foam. It also reduced the foaming in the automatic washers so that the instant detergents could be used in all brands of washers without excessive foaming causing drainage problems in some cases. Simultaneously it increased the cloud point (the temperature at which oil and water or water based chemicals separate into different layers). It needed to be above 105° F. for warm storage spaces and now they are stable above 105° F. It was found that after several months some of the minerals would start to precipitate or come out of solution and collect on the bottom of the container. This was accomplished by reducing certain of the least soluble minerals (sodium and Sodium Tripolyphosphate), eliminating the calcium chloride and without hurting the performance characteristics of the detergents. Use of a better alkoxylate solubilizer (namely HRE 40 and AS 48) also helped. These changes actually improved the performance of the detergents. Now only one enzymatic and one base detergent are needed.

The two detergents which are used in this process are as follows:

The Base Detergent

| Raw Material | % | % |
|---|---|---|
| Water | 94.9 | 80-96 |
| Sodium Tripolyphosphate | 1.2 | 0.5-1.5 |
| Propylparaben | 0.002 | 0.002-0.004 |
| Methylparaben | 0.002 | 0.002-0.004 |
| LS 54 | 1.2 | 1-3 |
| SXS | 0.7 | 0.1-1.0A |
| AS48 | 1.2 | 1-2.5 |
| R131 | 0.8 | 0.5-1.5 |
| Organo-silicone | 0.01 | 0.005-0.02 |

Eco-Zyme (Auto)

| Raw Material | % | % range |
|---|---|---|
| Sodium Formate | 0.17 | 0.1-0.5 |
| Sodium Tripolyphosphate | 1.26 | 0.4-2.0 |
| Sodium Borate | 1.14 | 1-2 |
| LS 54 | 4.0 | 3-7 |
| SXS | 1.14 | 0.1-2 |
| Protease (660) | 2.5 | 1.5-4 |
| Amylase (L-340) | 1.5 | 0.5-2.5 |
| Methyl Paraben | 0.04 | 0.03-0.1 |
| Propyl Paraben | 0.04 | 0.03-0.1 |
| HRE 40 | 13.82 | 10-15 |
| Dehypon E 124-90 | 1.94 | 1-4 |
| Fragrance | 0.02 | 0.005-1 |
| Water | 61.58 | 55-65 |
| Propylene Glycol | 6.10 | 5-12 |
| NF 5 | 1.36 | 1-2 |
| AS48 | 2.0 | 1.0-4.0 |
| R131 | 2.74 | 1.0-4.0 |
| Organo-silicone | 0.04 | 0.02-0.06 |

The specific ingredient, range and purpose of each ingredient (in the enzymatic formulation Ecozyme is as follows Water (55 to 65%)

Water is present in this formulations from 55 to 65% depending on the specific formulation. Water is the main or base solvent in this formulation. It is the main ingredient that holds everything together and keeps the solution in a liquid form. Too little water and the preservatives and minerals (sodium formate, sodium tripolyphosphate and sodium borate) will fall out of solution collecting on the bottom as a hard solid. Too much water and the enzymes are activated and destroy one another.

Sodium Formate (0.1 to 0.5%)

This ingredient helps keep the enzymes from activating until the solution is diluted with more water. It constitutes a buffering agent to keep the pH stable as a slightly alkaline or basic solution. It also reacts with trivalent metal ions found in hard water (tap water) and can collect on or bond to ion based (stainless steel) instruments. This keeps those metal ions in the tap water from interfering with the enzymes ability to react with body fluids and takes those already on the instruments off of them giving them more of a shine.

Sodium Tripolyphosphate or STPP (0.4 to 2.0%)

This is a stronger buffer than the sodium formate making sure the pH stays alkaline or basic. The enzymes we use need to be in an alkaline solution to keep them from breaking down during storage. The STPP is also a very good sequestering agent in that it bonds to and removes the metal ions in hard water not removed by the sodium formate (like the hard water deposits found on faucets and bathroom walls and other metal oxides) keeping them off of the cleaning equipment and instruments. It also removes those water deposits and other staining oxides that have already stuck to the cleaning equipment and instruments. It is also a builder for the surfactants in that it helps the surfactants work faster by removing the metal oxides that can bond to surfactants reducing their ability to make oils soluble in water. When put into warm or hot water STPP will partially change into a mild form of phosphoric acid which is used to remove rust and rustproof iron based metals like stainless steel.

Nonionic Surfactant Solubilizer Alkoxylate (HRE 40 or Polyethylene Glycol 40) (10 to 15%)

This ingredient is used to increase the capacity of water to hold more of the inorganic salts in solution (Items 2, 4, 13 and 14). It does this by opening up the water molecule to a wider angle between the hydrogen atoms. This makes the water molecule more linear and less V shaped. This allows water and oil mixtures to stay together better instead of separating over time. This particular surfactant also increases the cloud point or temperature where the oil and water elements separate into different layers.

Protease Enzyme (1.5 to 4.0%).

This ingredient digests protein molecules like blood and most body fluids. They start working when diluted with water to approximately 65% depending on the temperature and what stabilizers are used. Calcium, found in all tap water, acts as a catalyst by helping it break down the proteins.

Amylase Enzyme (0.5 to 2.5%)

Amylase breaks down certain carbohydrates like starches and celluloses into sugars which dissolve better in water making them easier to wash away. It does this by hydrolysis. Hydrolysis is the reaction of water with other substances to make a different substance. The amylase makes the water react with the starches and celluloses.

Fatty Alcohol Alkoxylated Nonionic Surfactant (Dehypon LS 54) (3.0% to 7.0%)

This ingredient is an environmentally safe, non-toxic defoamer and wetting agent. This one is slightly more attracted to oil than water, thus the low foaming. It is, however, temperature sensitive such that it works better at higher temperatures. This means that by adjusting the ratio, the temperature of least foaming will be adjusted as well. This is used to make the maximum defoaming action occur at between 110° F. and 125° F. so it can be used in the soaking process at a lower temperature and in the automatic washing machine at a higher temperature. This also affects the "as is" or undiluted detergent cloud point as recited above so that ratio must be controlled.

Alkyl Poly Glucoside Nonionic Surfactant (Simulsol AS48) (1% to 4%)

This is another environmentally safe non-toxic low foaming solubilizing agent. This one is also slightly more attracted to oil than water, thus the low foaming. It is, however, similar to the HRE 40 in that it is a solubilizer. This is used to keep the organic ingredients in solution with the water without taking away the solubility properties of the water for the sodium based inorganic salts (sodium borate, sodium formate and sodium tripolyphosphate)

Alkoxylated Nonionic Surfactant (Puronic 31R1) (1-4%)

This ingredient is a surfactant that is much more attracted to oil than water which helps to control the foaming action when diluted but must be used in small amounts or it will separate out of solution. It is a very strong wetting agent used for fast acting metallic cleaning action which is therefore a booster or helps the enzymes work faster and more thoroughly. It will lower the HLB or the ability of the water and oils staying together which is where the two next described ingredients are helpful.

Alcohol Alkoxylate (Dephypon E 124-90) (1.5 to 9%)

This ingredient allows the Alkoxylated Pluronic 31R1 nonionic surfactant to work without coming out of solution. As with the HRE 40 it opens up the water molecule so it can hold more inorganic salts, this is attracted to both water and oil more equally. It has a higher but not too high HBL which allows the lower HLB surfactants, like the alkoxylated Pluronic 31R1 nonionic surfactant to stay in solution by making a stable emulsion keeping the HLB surfactant from separating. Emulsions are substances mixed together that cannot become a true solution and will, over time, separate into different layers.

Sodium Alkane Sulfonate (Sodium Xylene Sulfonate or SXS) (0.05% to 2.0%)

This is an anionic surfactant that acts as a solubilizer. It is needed to help the Water hold the cationic ions in solution better. At too high a concentration it can hurt the protease but at low levels it is compatible. It also aids in wetting surfaces and speeds up the cleaning action of other surfactants. It is low foaming and helps keep the oil/water mixture together by giving the water more strength to hold onto the less water soluble ingredients.

Sodium Borate Decahydrate (Borax) (1 to 2%)

This ingredient's main use is to bond with the propylene glycol creating a propylene diol that weakly bonds to the enzymes. This weak bond keeps the enzymes from breaking down or activating which keeps the enzymes in a dormant like state until diluted with enough water to make a solution that is greater than about 70% water. More water and heat or hot water and the bond breaks faster. This keeps the enzymes stable for about 18 months. The enzyme used in the present invention was tested to determine the DAPU level based on a control and a alkaline protease unit and found that the enzymes were stable for 18 months. In addition, field testing in hospitals was carried out. Sodium borate is a fungicide preservative and cleaning booster. As a booster it has some cleaning properties of its own so it helps the surfactants work better.

Propylene Glycol (5 to 12%)

This ingredient bonds strongly to water so it keeps the water away from the enzymes which protects the enzymes from being activated by water. It also bonds with the sodium borate to create a diol that weakly bonds with the enzymes giving even more stability to the enzymes. Propylene glycol also lowers the solutions freezing point and in this case keeps it from freezing at temperatures below minus 10° F. It also helps keep the other less water soluble ingredients, the parabens and sodium borate, in solution.

Propylparaben (0.03 to 0.1%)

This ingredient is used as a preservative in many household detergents and some foods to prevent the growth of fungi. Because each type of paraben is affective on a particular type of fungi it is used in conjunction with other parabens such as Methylparaben, described below, to kill more types of fungi.

Methylparaben (0.03 to 0.1%)

This is a preservative used in many household detergents and some foods to prevent the growth of fungi. Because each type of paraben is affective on a specific type of fungi it is used in conjunction with other parabens such as propylparaben as described above to kill more types of fungi.

Fragrance (0.005 to 1%)

A fragrance is used to hide or cover the unpleasant odor that comes from the enzymes. Since enzymes are produced from Bacteria they have a bacteria or protein (urea) odor which is not harmful but unpleasant. A mild, pleasing fragrance was developed to cover up this odor without adding odor of its own.

Organo-Silicone (0.03 to 0.06%)

This is an organic base silicone that is soluble in water in small amounts and biodegradable. When the detergent is diluted in water, it lowers the surface tension so that suds cannot form.

Steps in the Blending of the Ingredients

During phase 1 of the process, water in the range of 38 to 45% is added to the ingredients Sodium Formate and Sodium Borate.

During Phase 2, the hot water content is from 55 to 62% and combined with the Sodium tripolyphosphate (STPP) until dissolved. The following ingredients are then added and mixed:

Nonionic surfactant solubilizer alkoxylate

Fatty alcohol alkoxylated nonionic surfactant (Dehypon LS 54)

Alkyl Poly Glucoside nonionic surfactant (Simulsol AS48)

Alkoxylated nonionic surfactant (Pluronic 31R1)

Alcohol Alkoxylate (Dehypon E124-90)

Sodium alkane sulfonate (sodium xylene sulfonate or SXS)

Fragrance

DeFoamer (organo-silicone)

Next the following ingredients are added together as Phase 3:

Protease enzyme

Amylase enzyme

Polypropylene Glycol

Propylparaben

Methylparaben

Phase I is then cooled and the Phase 3 mix is added to it.

Phase 2 mix is cooled and the combined Phase 1 and 3 mixes are added to it.

The alkoxylates from the parent case have been changed to other alkoxylates to reduct foaming and adjust the cloud point (the temperature of the solution turns cloudy or phase separation begins). To remedy this the percentages of the alkoxylates were adjusted to get the same solution temperature stability and cleansing properties that were desired.

The reasons for adjusting the percentages from the parent case were as follows:

55 to 65% Water.

Stability testing over several months showed that more water was needed along with solubilizers to keep the inorganic salts in solution and to keep the solution from separating into two layers and to improve the shelf life Any more water would tend to reduce the life of the protease enzyme.

0.1 to 0.5% Sodium Formate

A reduction in the sodium formate was made to accommodate the need for a reduced concentrated formula for automatic washers after soaking. Also to reduce sodium content to improve solubility and increase shelf life.

0.4 to 2.0% Sodium Tripolyphosphate (STPP)

The same excellent cleaning results were obtainable with less sodium Tripolyphosphate. By lessening this ingredient it was found that it did not require more solubilizers and water to keep it in solution.

10 to 15% Nonionic Surfactant Solubilizer Alkoxylate (HRE 40) or Polyethylene Glycol 40)

The stability studies showed that more of a solubilizer with a higher cloud point was needed so that the product would tolerate higher storage and shipping temperatures for a longer time period. This also improved the solubility properties for the inorganic salts. A nonionic surfactant, HRE 40, from Cognis, was found to be the best choice and most compatible. It also allowed us to reduce the percentage of SXS or sodium alkane sulfonate.

1.5 to 4.0% Protease Enzyme

As with the sodium formate, the automatic washers did not need as much protease enzyme to finish the cleaning process after the soaking process. While some customers wished a more concentrated form so that they could use less at a time. It was found that only one enzymatic formula was needed but used at different amounts per gallon of water depending on where is was used (sink or automatic washer).

0.5 to 2.5% Amylase Enzyme.

The range of from 1 to 3% of amylase enzyme is fine but more than is needed, so a slight reduction to 0.5 to 2.5% was used.

3.0% to 7.0% Fatty Alcohol Alkoxylated Nonionic Surfactant (Dehypon LS 54); 1-4% Alkyl Poly Glucoside Nonionic Surfactant (Simulsol AS48)

1.0 to 4% Alcohol Alkoxylate (Dehypon E 124-90)

It was found through field testing that the foaming needed to be reduced and to decrease the amount of hot water cloud point to stop excess foaming in the automatic washer. Consequently, the alkoxylate surfactant ratios were adjusted and two other surfactants from Cognis, Dehypon E124-90, was added and the Bioterg from Stepan from the parent case was eliminated. The Dehypon LS54 helped reduce the foaming and provided a higher cloud point to keep it from separating at higher temperatures during storage. The Simulsol AS48 gave less foaming by adjusting the diluted cloud point down when in hot water and improved overall solubility properties. The Dehypon E 124-90 helped reduce foaming overall when used for soaking and automatic dishwashers.

1.0% to 4.0% Alkoxylated Isopropanolamide Nonionic Surfactant (Pluronic 312R1)

Through stability studies it was found that the alkoxylate isopropanolamide had to be replaced to keep it from separating. It was replaced with Pluronic 31R1 to reduce foaming and it is an excellent wetting agent for use on soiled metals. It is also more compatible with the formulation therefore stopped the separation and improved wetting properties.

0.1 to 2.0% Sodium Alkane Sulfonate (Sodium Xylene Sulfonate or SXS)

Field tests and stability testing showed that the SXS (sodium xylene sulfonate) was better for reducing the foam than NF 12 from Stepan which added to the foaming problems. When SXS was used in conjunction with the HRE 40 it improved the solubility and protease stability over time by reducing the amount of water.

1 to 2% Sodium Borate Decahydrate (Borax)

The sodium borate decahydrate concentration did not need to be changed. It is still keeping the enzymes stable at this level.

5 to 12% Propylene Glycol

Stability testing showed that the percent of propylene glycol should be reduced to avoid separation issues. Separation occurred after several months if there was too much propylene glycol.

0.03 to 0.1% Propylparaben 0.03 to 0.1% Methylparaben

Stability testing showed that the percent parabens was slightly too high for the solubility properties of the parabens. Only half as much was needed to preserve the product.

0.005 to 1% Fragrance

The new and different ratios of the alkoxylates reduced the unpleasant odor so much that the amount of fragrance was also reduced.

0.02 to 0.04% Organo-Silicone

A very small amount of this water soluble defoamer was needed to reduce excessive foaming with strong agitation as in automatic washers.

Having described a first preferred embodiment of the invention followed by a description of a second preferred embodiment it will be obvious to those of ordinary skill in the art to come up with other modifications and changes that are covered by the scope of the appended claims.

What is claimed is:

1. A non-toxic and environmentally safe enzymatic base cleaner for cleaning medical equipment and instruments which have bio-residue thereon, said non-toxic cleanser consisting of the following components:

Water, sodium tripolyphophate, propylparaben, methylparaben, alkoxylated nonionic low foaming fatty alcohol, hydrotropic surfactant and solubilizer, low foaming alkyl polyglucoside, alkoxylated nonionic surfactant, organosilicone and optionally fragrance.

2. A cleanser as in claim 1 wherein said water is present from 80-96% by weight.

3. A cleanser as in claim 1 wherein said propylparaben is present from 0.002 to 0.0004% by weight.

4. A cleanser as in claim 1 wherein said sodium tripolyphosphate is present from 0.5 to 1.5% by weight.

5. A cleanser as in claim 1 wherein said methylparaben is present from 0.002-0.004% by weight.

6. A cleanser as in claim 1 wherein said alkoxylated nonionic low foaming fatty alcohol is present from 1.0-3.0% by weight.

7. A cleanser as in claim 1 wherein said hydroptropic surfactant and solubilizer is present from 0.1 to 1.0% by weight.

8. A cleanser as in claim 1 wherein the fragrance is present.

9. A cleanser as in claim 8 wherein said low foaming alkyl polyglucoside is from 1.0-2.5% by weight.

10. A cleanser as in claim 1 wherein said alkoxylated nonionic surfactant is present from 0.5-1.5% by weight.

11. A cleanser as in claim 1 wherein said organosilicone is present from 0.005 to 0.02% by weight.

12. A non-toxic and environmentally safe enzymatic cleanser for cleaning equipment and instruments which have bio-residue adhered thereto in a dried state, said non-toxic cleanser consisting of the following components:

Water, sodium formate, sodium tripolyphosphate, sodium borate, alkoxylated nonionic low foaming fatty alcohol, hydrotropic surfactant and solubilizer, protease, amylase, methylparaben, propylparaben, polyoxyethylene hydrogenated castor oil, alcohol alkoxylate, fragrance, propylene glycol, alkoxylated isopropylamide methyl ester, low foaming alkyl polyglucoside, alkoxylated nonionic surfactant and organosilicone.

13. A cleanser as in claim 12 wherein said water is present from 53-65% by weight.

14. A cleanser as in claim 12 wherein said sodium formate is present from 0.1-1.5% by weight.

15. A cleanser as in claim 12 wherein said sodium tripolyphosphate is present from 0.4-2.0% by weight.

16. A cleanser as in claim 12 wherein said sodium borate is present from 1-2% by weight.

17. A cleanser as in claim 12 wherein said alkoxylated nonionic low foaming fatty alcohol is present from 3-7% by weight.

18. A cleanser as in claim 12 wherein said hydrotropic surfactant and solubilizer is present from 0.1-2.0% by weight.

19. A cleanser as in claim 12 wherein said protease is present from 1.5-4.0% by weight.

20. A cleanser as in claim 12 wherein said amylase is present from 0.5-2.5% by weight.

21. A cleanser as in claim 12 wherein said methylparaben is present from 0.03-0.1% by weight.

22. A cleanser as in claim 12 wherein said propylparaben is present from 0.03-0.1% by weight.

23. A cleanser as in claim 12 wherein said polyoxyethylene hydrogenated castor oil is present from 10-15% by weight.

24. A cleanser as in claim 12 wherein said alcohol alkoxylate is present from 1-4% by weight.

25. A cleanser as in claim 12 wherein said propylene glycol is present from 5-12% by weight.

26. A cleanser as in claim 12 wherein said alkoxylated isopropylamide methyl ester is present from 1-2% by weight.

27. A cleanser as in claim 12 wherein said low foaming alkyl polyglucoside is present from 1-4% by weight.

28. A cleanser as in claim 12 wherein said alkoxylated nonionic surfactant is present from 1-4% by weight.

29. A cleanser as in claim 12 wherein said organosilicone is present from 0.02-0.05 by weight.

* * * * *